US006345165B2

(12) United States Patent
Takano et al.

(10) Patent No.: US 6,345,165 B2
(45) Date of Patent: Feb. 5, 2002

(54) FULL-COLOR TONER CARTRIDGE, METHOD FOR SUPPLYING TONER FROM CARTRIDGE AND METHOD FOR FILLING TONER CARTRIDGE WITH TONER

(75) Inventors: Hiroshi Takano; Yuusaku Shibuya; Masanobu Ninomiya; Fumiaki Mera; Haruhide Ishida, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/729,340

(22) Filed: Dec. 5, 2000

(30) Foreign Application Priority Data

Jan. 12, 2000 (JP) ..... 12-003233

(51) Int. Cl.[7] ..... G03G 15/08
(52) U.S. Cl. ..... 399/263
(58) Field of Search ..... 399/258, 262, 399/263

(56) References Cited

U.S. PATENT DOCUMENTS 5,289,955 A * 3/1994 Sulenski ..... 399/262 X

FOREIGN PATENT DOCUMENTS

JP 11-282201 10/1998

* cited by examiner

*Primary Examiner*—Susan S. Y. Lee
(74) *Attorney, Agent, or Firm*—Oliff & Berridge, PLC

(57) ABSTRACT

Provided is a full-color toner cartridge in which the toner does not block and which therefore ensures stable formation of high-quality images. The cartridge has a cylindrical container provided with a toner supply port and is detachable from a developing machine. In this, the container is provided with an agitating unit, and the toner to be filled into the container contains wax having a softening point of not higher than 120° C. and satisfies the following formulae (1) and (2):

$$A/(B \times D \times \pi) \leqq C \ (C=65) \quad (1)$$

$$B \geqq 0.5 \quad (2)$$

wherein A indicates the amount of the toner to be filled into the cartridge (g); B indicates the apparent tapped density of the toner (g/cm$^3$); D indicates the inner diameter of the cylindrical container (cm); and π indicates the ratio of the circumference of a circle to its diameter.

16 Claims, 1 Drawing Sheet

FULL-COLOR TONER CARTRIDGE, METHOD FOR SUPPLYING TONER FROM CARTRIDGE AND METHOD FOR FILLING TONER CARTRIDGE WITH TONER

BACKGROUND OF THE INVENTION

1. Field of the Invention

The present invention relates to a full-color toner cartridge applicable to electrophotographic duplicators, printers, facsimiles, etc., to a method of supplying toner from the cartridge into developing units, and to a method of filling toner into the toner cartridge.

2. Description of the Related Art

For supplying a fresh toner to a developing unit, widely used is a toner cartridge, as being easy to handle and enabling easy toner supply to the unit without scattering the toner. The toner cartridge functions as a toner container before it is fitted into a developing unit, and, after having been fitted thereinto, it functions as a toner supply tank.

As in FIG. 1 and FIG. 2, the toner cartridge is generally provided with a cartridge body 1, a spiral agitator (agitating and conveying member) 2, a coupling member 3 and a sealing member 4.

The cartridge body 1 is provided with a cylindrical container with its both ends being sealed with side walls 1*b* and 1*b*′, and has a toner outlet port 1*c* through the side wall adjacent to either one of right and left side walls, for example, adjacent to the side wall 1*b*′ as illustrated.

The spiral agitator 2 is rotatably so disposed in the cartridge body 1 that it can rotate to agitate the toner therein while conveying it toward the outlet port 1*c* for development.

The coupling member 3 has a shaft 3*a* that rotatably runs through the other side wall 1*b* into the cartridge body 1, and a coupling part 3*b* that is positioned outside the side wall 1*b* and is connected with a driving source (not shown). With these, the coupling member 3 is connected with the agitator 2 to transmit the driving power from its source to the agitator 2.

The sealing member 4 is fixed to the inner surface of the side wall 1*b* of the cartridge body 1, and is so disposed that it has a through-hole 4*a* through which the shaft 3*a* of the coupling member 3 is airtightly and rotatably runs into the cartridge body 1 in the sealed region, and that it seals the gap between the shaft 3*a* and the side wall 1*b* of the cartridge body 1 through which the shaft 3*a* runs into the cartridge body 1.

Heretofore, black toner contains wax having a relatively high melting point, such as polyethylene, polypropylene or the like, for ensuring good offset resistance in fixation. However, such a high-melting-point wax is unfavorable to full-color toner, as often detracting from the transparency of OHP images and often requiring relatively high temperature fixation. Accordingly, wax is not added to full-color toner. In place of it, a liquid of silicone oil or the like is applied to the surface of a thermal fixation roller for preventing offset in fixation. This method will be extremely effective for easily releasing the image-printed media from the fixation roller with no trouble of offsetting, but is often problematic in that it requires a large-sized fixation unit and that the image-printed media are sticky.

In that situation, desired is oilless full-color toner that contains wax for full-color image formation.

Toner cartridges used these days have a complicated structure and are expensive. Therefore, the amount of the toner to be filled into them is desired to be as large as possible in order to reduce the printing cost per one print. Accordingly, toner cartridges are so designed that the cartridge capacity could be as large as possible.

However, in case where toner cartridges are so designed that they could be filled with an enlarged amount of toner or the diameter of the cartridge body is enlarged, the powder pressure in the cartridges shall increase. In particular, when such toner cartridges are left in a high-temperature and high-humidity atmosphere for a long period of time, then the contact surface of the toner particles therein will increase and the toner particles will block together. Such toner blocking is unfavorable. If toner particles in a cartridge block together, the toner could not be well conveyed to a developing unit, and even if conveyed thereto, the blocked toner lumps still remain as they are without being crushed, thereby causing color steaks and other image defects in the images formed. In particular, full-color toners containing low-melting-point wax will aggregate owing to the low-melting-point wax therein, and will therefore readily block while in cartridges.

SUMMARY OF THE INVENTION

The present invention is to solve the problems noted above. Specifically, the invention is to provide a full-color toner cartridge free from toner blocking therein and ensuring stable high-quality image formation; a method of supplying toner from the cartridge to a developing unit; and a method of filling toner into the toner cartridge.

We, the present inventors have assiduously studied and, as a result, have found that the aims of the invention can be attained by the following:

<1> A full-color toner cartridge detachable from a developing machine, the cartridge including a cylindrical container having an opening for toner discharge and an agitating unit and a toner, in which the toner contains wax having a softening point of not higher than 120° C. and the following formulae (1) and (2) are satisfied:

$$A/(B\times D\times\pi)\leqq C(C=65) \quad (1)$$

$$B\geqq 0.5 \quad (2)$$

where A indicates the amount of the toner to be filled into the cartridge (g); B indicates the apparent tapped density of the toner (g/cm$^3$); D indicates the inner diameter of the cylindrical container (cm); and π indicates the ratio of the circumference of a circle to its diameter.

<2> A method for filling a toner cartridge with a full-color toner, wherein the toner cartridge has a cylindrical container provided with an opening for toner discharge and is detachable from a developing machine, and the toner to be filled into the container contains wax having a softening point of not higher than 120° C. and the following formulae (1) and (2) are satisfied:

$$A/(B\times D\times\pi)\leqq C(C=65) \quad (1)$$

$$B\geqq 0.5 \quad (2)$$

where A indicates the amount of the toner to be filled into the cartridge (g); B indicates the apparent tapped density of the toner (g/cm$^3$); D indicates the inner diameter of the cylindrical container (cm); and π indicates the ratio of the circumference of a circle to its diameter.

<3> A method for supplying toner into a developing unit through the opening of the toner cartridge of above (1).

BRIEF DESCRIPTION OF THE DRAWINGS

Preferred embodiments of the invention will be described in detail based on the following figures, wherein.

DESCRIPTION OF THE PREFERRED EMBODIMENTS

The invention is described in detail hereinunder.

The full-color toner cartridge detachable from a developing machine of the invention may be of any type having a cylindrical container having an opening for toner discharge.

Various types of materials are usable for constructing the cartridge. For example, usable are various resins such as ABS, POM, PS, etc. These days preferred are ABS resins.

Figure 1:
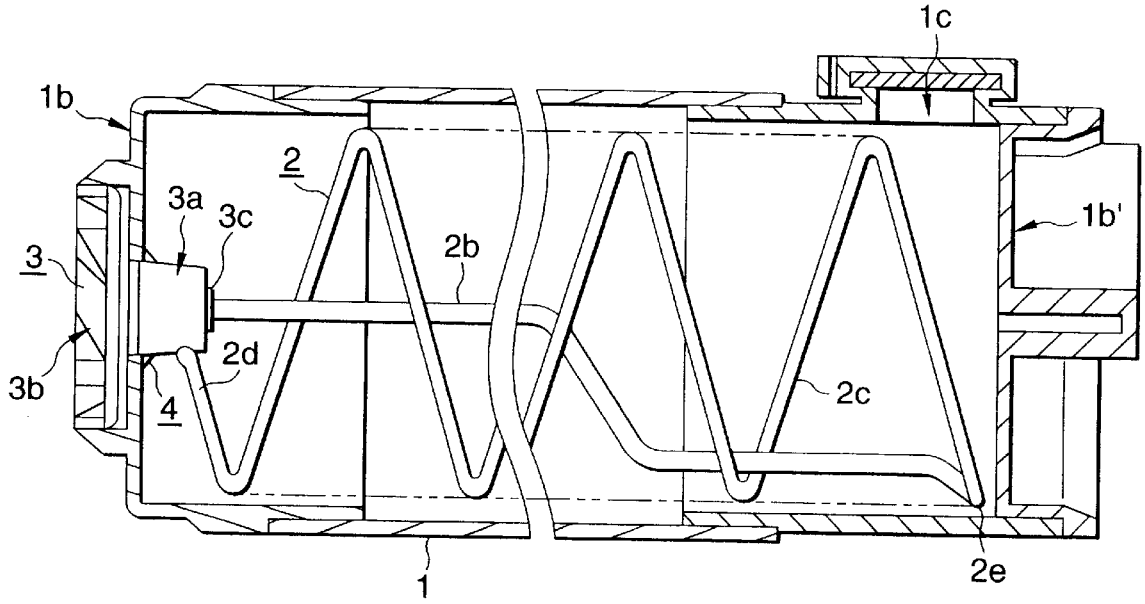
FIG. 1 is a schematic cross-sectional view of a toner cartridge provided with a cylindrical container.
Figure 2:
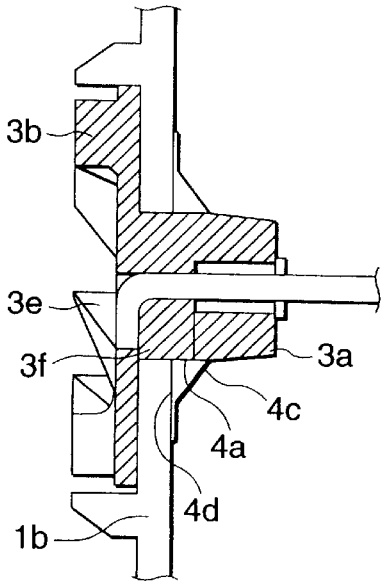
FIG. 2 is a schematic view showing in detail the disposition of the sealing member and the coupling member in FIG. 1.

The full-color toner cartridge of the invention is provided with a cylindrical container having an opening for toner discharge. The container has the function of conveying toner to a developing unit. Through its opening, the container supplies toner into a developing unit, and it functions as a supply tank for toner. The opening for toner discharge may be disposed, for example, like the toner outlet port 1*c* as in FIG. 1.

The cylindrical container is provided with an agitating unit for agitating toner therein. The agitating unit may be a spiral agitator (or an auger), for example, as in FIG. 1, but is not limited thereto. For constructing the agitating unit, for example, employable are metallic materials such as stainless materials and others, which, however, are not limitative.

The full-color toner cartridge of the invention is so constituted that it is detachable from a developing machine. Its detachable constitution may be any known one.

The toner to be filled into the full-color toner cartridge of the invention is described below.

The toner applicable to the invention contains (i) a binder resin and (ii) resin particles containing a colorant and wax. Optionally but preferably, the toner contains (iii) an external additive. Also preferably, the toner further contains fine inorganic particles inside the toner particles.

The binder resin that may be in the toner applicable to the invention includes, for example, homopolymers and copolymers of styrenes such as styrene, chlorostyrene, etc.; monoolefins such as ethylene, propylene, butylene, isobutylene, etc.; vinyl esters such as vinyl acetate, vinyl propionate, vinyl benzoate, vinyl butyrate, etc.; aliphatic α-methylene-monocarboxylates such as methyl acrylate, ethyl acrylate, butyl acrylate, octyl acrylate, dodecyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc.

Specific examples of the binder resin are polystyrenes, styrene-alkyl acrylate copolymers, styrene-alkyl methacrylate copolymers, styrene-acrylonitrile copolymers, styrene-butadiene copolymers, styrene-maleic anhydride copolymers, polyethylenes, polypropylenes, etc. Also usable for the binder resin are polyesters, polyurethanes, epoxy resins, silicone resins, polyamides, modified rosins, paraffin waxes, etc.

The colorant to be in the toner includes, for example, carbon black, aniline blue, chalcoyl blue, chrome yellow, ultramarine blue, DuPont oil red, quinoline yellow, methylene blue chloride, copper phthalocyanine, malachite green oxalate, lamp black, rose bengale, C.I. Pigment Red 48:1, C.I. Pigment Red 122, C.I. Pigment Red 57:1, C.I. Pigment Red 81:1, C.I. Pigment Yellow 97, C.I. Pigment Yellow 180, C.I. Pigment Yellow 12, C.I. Pigment Yellow 17, C.I. Pigment Blue 15:1, C.I. Pigment Blue 15:3, etc.

Wax to be in the toner may be a wax-derived substance including, for example, the following: Paraffin wax and its derivatives, montan wax and its derivatives, microcrystalline wax and its derivatives, Fisher-Tropsch wax and its derivatives, polyolefin wax and its derivatives, etc. The derivatives include oxides, polymers with vinyl monomers, and graft-modified derivatives. In addition to these, also usable are alcohols, fatty acids, vegetable waxes, animal waxes, mineral waxes, ester waxes, acid amides, etc.

Preferably, wax to be in the toner has a melting point of from 80 to 120° C., more preferably from 80 to 100° C., even more preferably from 80 to 90° C. If the melting point of the wax in the toner is too low, the antiblocking property of the toner will be poor. If so, in addition, the developability of the toner will worsen when the temperature inside duplicators has increased high. On the other hand, even if the melting point of the wax in the toner is too high, it will cause no problem for high-temperature fixation, which, however, is undesirable for energy saving.

Preferably, the resin particles (ii) contain fine inorganic particles. For the fine inorganic particles, generally preferred are fine inorganic oxide particles. They include, for example, fine particles of $SiO_2$, $TiO_2$, $Al_2O_3$, MnO, ZnO, MgO, CaO, $K_2O$, $Na_2O$, $SnO_2$, $ZrO_2$, $TiO(OH)_2$, $CaO.SnO_2$, $K_2O.(TiO_2)_n$, etc.

One type or two or more different types of such inorganic fine particles may be in the toner either singly or as combined.

Of those, especially preferred are $TiO_2$ and $SiO_2$.

The particle size of these fine inorganic particles, especially that of fine inorganic oxide particles preferably falls between 3 nm and 1 μm, more preferably between 5 nm and 100 nm.

The toner applicable to the invention may contain (iii) an external additive as above.

The external additive includes, for example, fine inorganic particles, especially fine inorganic oxide particles such as those that may be in the resin particles (ii). The external additive (iii) and the fine inorganic particles that may be in the resin particles (ii) may be the same or different.

The particle size of the external additive (iii) may be on the same level as that of the fine inorganic particles to be in the resin particles (ii), for example, preferably falling between 3 nm and 1 μm, more preferably between 5 nm and 100 nm.

In addition to fine inorganic particles as above, the external additive further includes fine organic particles. However, in case where fine organic particles alone are added to the toner, the powdery flowability of the toner will be poor to cause toner conveyance failure in the toner cartridge. Therefore, it is desirable that fine organic particles are combined with fine inorganic particles for use in the toner.

The toner applicable to the invention may contain, if desired, any other components. The additional components include, for example, a charge controlling agent, a cleaning aid, etc.

Preferably, the toner applicable to the invention has a predetermined, apparent tapped density ($g/cm^3$).

The apparent tapped density (g/cm$^3$) of the toner for use herein is obtained by the use of a bulk densitometer according to a tapping method, for example, as follows: A toner to be measured is put into a container of which the volume (cm$^3$) is known, and the container with the toner therein is tapped 180 times to a height of 18 mm. The weight (g) of the toner capable of being packed into the container in that condition is measured. From the thus-measured weight of the toner and the known volume of the container, obtained is the apparent tapped density of the toner.

In the invention, the toner to be used satisfies the following formulae:

$$A/(B\times D\times\pi)\leqq C(C=65) \quad (1)$$

$$B\geqq 0.5 \quad (2)$$

wherein A indicates the amount of the toner to be filled into the cylindrical container of the cartridge of the invention, or that is, the amount of the toner to be packed into the container (g); B indicates the apparent tapped density of the toner (g/cm$^3$); D indicates the inner diameter of the cylindrical container (cm); and $\pi$ indicates the ratio of the circumference of a circle to its diameter.

The left-side part of the inequality (1) indicates the powder pressure to be applied to the inside area of the cartridge. A high value of the left-side part, if larger than C of 65, means that the powder pressure inside the cartridge is high. Such high powder pressure inside the cartridge causes toner blocking in the cartridge. On the other hand, when the powder pressure is not higher than 65, the toner particles in the cartridge will hardly block.

Preferably, the apparent tapped density of the toner to be in the cartridge is larger than 0.5 (g/cm$^3$), more preferably from 0.5 to 0.8, even more preferably from 0.6 to 0.8. Toner having a too low apparent tapped density is unfavorable as its flowability is poor. Even though satisfying the requirement of formula (1), such poorly flowable toner will block.

EXAMPLES

The invention is described in more detail with reference to the following Examples, which, however, are not intended to restrict the scope of the invention.

Example 1

1—1. Preparation of Toner

The following ingredients are kneaded in an extruder, powdered in a jet mill, and classified through air classification to prepare colorant particles having a volume-average particle size of 7.5 $\mu$m.

| | |
|---|---|
| Linear polyester resin(*1) | 100 parts by weight |
| Magenta pigment (C.I. Pigment Red 57:1) | 6 parts by weight |
| Carnauba wax (Tm, 85° C. as the DSC peak) | 7 parts by weight |

(*1)Linear polyester obtained from terephthalic acid/bisphenol A-ethylene oxide adduct/cyclohexanedimethanol (Tg = 65° C., Mn = 5,000, Mw = 30,000)

To the resulting particles, added are 1 part of titania (prepared by processing 100 parts of rutile-type titania (mean particle size, 20 nm) with 16 parts of decyltrimethoxysilane) and 1 part of silica (prepared by processing silica (having a specific surface area of 50 m$^2$/g before processed) with dimethylsilicone oil, 100 cs), and mixed in a Henschel mixer to prepare a toner. Its apparent tapped density is 0.6 (g/cm$^3$).

1-2. Preparation of Carrier

The following ingredients except ferrite particles are milled to prepare a dispersion for forming a coating layer.

| | |
|---|---|
| Ferrite particles (Cu—Zn ferrite, mean particle size 35 $\mu$m) | 100 parts by weight |
| Toluene | 20 parts by weight |
| Fluorine-containing acrylic resin (Mn = 15,000, Mw = 45,000) | 3.2 parts by weight |
| Carbon black (Cabot's VXC72 ®, mean particle size 30 nm) | 0.44 parts by weight |
| Fine particles of melamine resin | 0.3 parts by weight |

The coating layer-forming dispersion thus prepared is put into a vacuum degassing kneader along with ferrite particles, and stirred at 60° C. for 30 minutes therein, and then the solvent is removed. Thus is prepared a carrier.

1-3. Preparation of Developer

Using a V-blender, a developer having a toner concentration of 8 parts by weight is prepared.

1-4. Preparation of Toner Cartridge

A cylindrical container made of ABS (inner diameter 4.2 cm, length 32 cm) is prepared. A spiral, toner-agitating auger is fitted into the container to construct a toner cartridge. 160 g of the toner is filled into the toner cartridge.

Example 2

A toner cartridge is prepared in the same manner as in Example 1. For this, however, 2 parts by weight of titania (prepared by processing 100 parts of rutile-type titania (mean particle size, 20 nm) with 16 parts of decyltrimethoxysilane) and 2 parts of silica (prepared by processing silica (having a specific surface area of 50 m$^2$/g before processed) with dimethylsilicone oil, 100 cs) are added to the colorant particles to prepare a toner.

The apparent tapped density of the toner prepared herein is 0.63 (g/cm$^3$).

Example 3

A toner cartridge is prepared in the same manner as in Example 2. For this, however, the toner is so designed as to have a volume-average particle size of 6.5 $\mu$m. The apparent tapped density of the toner is 0.55 (g/cm$^3$).

Example 4

A toner cartridge is prepared in the same manner as in Example 1. For this, however, the toner is so designed as to have a volume-average particle size of 6.5 $\mu$m. The apparent tapped density of the toner is 0.5 (g/cm$^3$).

Example 5

A toner cartridge is prepared in the same manner as in Example 1. In this, however, the container has an inner diameter of 6.5 cm and is filled with 550 g of the toner.

Example 6

A toner cartridge is prepared in the same manner as in Example 5. In this, however, the container is filled with 600 g, of the toner of Example 4.

Example 7

A toner cartridge is prepared in the same manner as in Example 1. For this, however, 3 parts by weight of fine inorganic oxide particles of R972 (hydrophobic silica from Nippon Aerosil) are added to the resin particles in preparing the toner.

Comparative Example 1

A toner cartridge is prepared in the same manner as in Example 1. For this, however, the toner is so designed as to have a volume-average particle size of 6 μm. The apparent tapped density of the toner is 0.45 (g/cm$^3$).

Comparative Example 2

A toner cartridge is prepared in the same manner as in Example 6. In this, however, the container is filled with 650 g of the toner.

Comparative Example 3

A toner cartridge is prepared in the same manner as in Example 6. In this, however, the container has an inner diameter of 8 cm and is filled with 1,000 g of the toner.

Evaluation

After filled with toner, the toner cartridges of Examples and Comparative Examples are left for 1 day and for 1 month. Separately set in a modified duplicator (for this, Fuji Xerox's CLW3300 was so modified that a toner cartridge having a varying diameter could be set therein), these are tested for producing 1000 prints of A3-size paper. The printing test is conducted at 28° C. and 85% RH.

The prints are checked for color spots therein as follows: An image is printed on sheets of A3-size paper to have an image area of 50%, and the number of the color spots seen on the prints is counted at intervals of 200 prints. Though depending on their size, at most 5 color spots seen on the prints are on the acceptable level, but more than 5 color spots are unacceptable.

Similarly, the prints are checked for color streaks therein as follows: Ten prints are sampled out at intervals of 200 prints, and compared with standard prints of four ranks, G1 (good) to G4 (bad). G3 and G4 are unacceptable.

Table 1 below shows the test results of the toner cartridges of Examples and Comparative Examples. In this, A indicates the amount of the toner filled in the cartridge (g); B indicates the apparent tapped density of the toner (g/cm$^3$); D indicates the inner diameter of the cylindrical container (cm); and C is obtained by substituting A, B and D in formula (1) with their data. Ni indicates the number of color spots seen on the prints obtained by the use of fresh toner cartridges; NA indicates the number of color spots seen on the prints obtained by the use of stored toner cartridges; Gi indicates the color streak grade for the prints obtained by the use of fresh toner cartridges; and GA indicates the color streak grade for the prints obtained by the use of stored toner cartridges. Ex 1 to Ex 7 are Example 1 to Example 7, respectively; and Comp 1 to Comp 3, are Comparative Example 1 to Comparative Example 3, respectively.

From Table 1, it is understood that the toner cartridges of Examples produce high-quality images.

TABLE 1

Results of Evaluation Test of Toner Cartridges of Examples and Comparative Examples

| | A (g) | D (cm) | B | C | Ni | Gi | NA | GA | Evaluation |
|---|---|---|---|---|---|---|---|---|---|
| Ex 1 | 160 | 4.2 | 0.6 | 20 | 2 | G1 | 3 | G1 | good |
| Ex 2 | 160 | 4.2 | 0.63 | 19.2 | 2 | G1 | 2 | G1 | good |
| Ex 3 | 160 | 4.2 | 0.55 | 22 | 3 | G1 | 5 | G1 | good |
| Ex 4 | 160 | 4.2 | 0.5 | 24 | 5 | G1 | 5 | G2 | good |
| Ex 5 | 550 | 6 | 0.6 | 48.6 | 4 | G1 | 2 | G2 | good |
| Ex 6 | 6000 | 6 | 0.5 | 63.7 | 5 | G2 | 5 | G2 | good |

TABLE 1-continued

Results of Evaluation Test of Toner Cartridges of Examples and Comparative Examples

| | A (g) | D (cm) | B | C | Ni | Gi | NA | GA | Evaluation |
|---|---|---|---|---|---|---|---|---|---|
| Ex 7 | 160 | 4.2 | 0.6 | 20 | 0 | G1 | 0 | G1 | good |
| Comp 1 | 160 | 4.2 | 0.45 | 26.9 | 5 | G3 | 20 | G4 | bad |
| Comp 2 | 650 | 6 | 0.5 | 69 | 10 | G4 | 40 | G4 | bad |
| Comp 3 | 1000 | 8 | 0.5 | 79.6 | 15 | G4 | ≧50 | G4 | bad |

According to the invention, there are provided a full-color toner cartridge, a method of supplying toner from the cartridge into developing units, and a method of filling toner into the toner cartridge. The toner therein does not block, and the cartridge ensures stable formation of high-quality images.

While the invention has been described in detail and with reference to specific embodiments thereof, it will be apparent to one skilled in the art that various changes and modifications can be made therein without departing from the spirit and scope thereof.

The entire disclosure of Japanese Patent Application No. 2000-003233 filed on Jan. 12, 2000 including specification, claims, drawings and abstract is incorporated herein by reference in its entirety.

What is claimed is:

1. A full-color toner cartridge detachable from a developing unit, the cartridge comprising a cylindrical container for containing a toner, the container having an opening for toner discharge and an agitating member, wherein the toner contains wax having a softening point of not higher than 120° C. and the following formulae (1) and (2) are satisfied:

$$A/(B\times D\times\pi)\leqq C(C=65) \quad (1)$$

$$B\geqq 0.5 \quad (2)$$

where A indicates the amount of the toner to be filled into the cartridge (g); B indicates the apparent tapped density of the toner (g/cm$^3$); D indicates the inner diameter of the cylindrical container (cm); and π indicates the ratio of the circumference of a circle to its diameter.

2. The full-color toner cartridge as claimed in claim 1, wherein the toner further contains fine inorganic particles inside its particles.

3. The full-color toner cartridge as claimed in claim 2, wherein the fine inorganic particles have a mean particle size falling between 3 nm and 1 μm.

4. The full-color toner cartridge as claimed in claim 2, wherein the fine inorganic particles are selected from a group consisting of silicon oxide, titanium oxide, $Al_2O_3$, MnO, ZnO, MgO, CaO, $K_2O$, $Na_2O$, $SnO_2$, $ZrO_2$, TiObx;1$(OH)_2$, $CaO.SnO_2$, and $K_2O.(TiO_2)_n$.

5. The full-color toner cartridge as claimed in claim 1, wherein the toner contains an external additive.

6. The full-color toner cartridge as claimed in claim 5, wherein the external additive contains fine inorganic particles having a mean particle size from 3 nm to 1 μm.

7. The full-color toner cartridge as claimed in claim 1, wherein the wax in the toner has a melting point falling between 80° C. and 100° C.

8. A method for filling a toner cartridge with a full-color toner, wherein the toner cartridge comprises a cylindrical container for containing the toner, the container having an opening for toner discharge and being detachable from a developing unit, the method comprising the steps of:

causing the toner to contain wax having a softening point of not higher than 120° C.; and filling the cartridge with the toner so as to satisfy the following formulae (1) and (2):

$$A/(B\times D\times\pi)\leqq C(C=65) \quad (1)$$

$$B\geqq 0.5 \quad (2)$$

where A indicates the amount of the toner to be filled into the cartridge (g); B indicates the apparent tapped density of the toner (g/cm$^3$); D indicates the inner diameter of the cylindrical container (cm); and π indicates the ratio of the circumference of a circle to its diameter.

9. The method for filling a toner cartridge with a full-color toner as claimed in claim 8, wherein the toner further contains fine inorganic particles inside its particles.

10. The method for filling a toner cartridge with a full-color toner as claimed in claim 9, wherein the fine inorganic particles have a mean particle size falling between 3 nm and 1 μm.

11. The method for filling a toner cartridge with a full-color toner as claimed in claim 9, wherein the fine inorganic particles are selected from a group consisting of silicon oxide, titanium oxide, $Al_{2O3}$, MnO, ZnO, MgO, CaO, $K_2O$, $Na_2O$, $SnO_2$, $ZrO_2$, $TiO(OH)_2$, $CaO.SnO_2$, and $K_2O.(TiO_2)_n$.

12. The method for filling a toner cartridge with a full-color toner as claimed in claim 8, wherein the toner contains an external additive.

13. The method for filling a toner cartridge with a full-color toner as claimed in claim 12, wherein the external additive contains fine inorganic particles having a mean particle size of from 3 nm to 1 μm.

14. The method for filling a toner cartridge with a full-color toner as claimed in claim 8, wherein the wax in the toner has a melting point falling between 80° C. and 100° C.

15. A method for supplying toner into a developing unit through the opening for toner discharge of the toner cartridge of claim 1.

16. The method for supplying toner into a developing unit as claimed in claim 15, wherein the wax in the toner has melting point falling between 80° C. and 100° C.

* * * * *